US006634043B2

(12) United States Patent
Lamb et al.

(10) Patent No.: US 6,634,043 B2
(45) Date of Patent: Oct. 21, 2003

(54) MEDICAL TABLE HAVING CONTROLLED MOVEMENT AND METHOD OF USE

(75) Inventors: Steve R. Lamb, Diablo, CA (US); Russell E. Klein, Redwood City, CA (US); Michael C. Demaria, Oakland, CA (US); Stephen L. Hoel, Concord, CA (US)

(73) Assignee: Orthopedic Systems, Inc., Union City, CA (US)

( * ) Notice: Subject to any disclaimer, the term of this patent is extended or adjusted under 35 U.S.C. 154(b) by 0 days.

(21) Appl. No.: 09/953,352

(22) Filed: Sep. 11, 2001

(65) Prior Publication Data

US 2002/0023298 A1 Feb. 28, 2002

Related U.S. Application Data

(62) Division of application No. 09/044,363, filed on Mar. 19, 1998, now Pat. No. 6,286,164.

(51) Int. Cl.[7] ..... A47B 71/00

(52) U.S. Cl. ..... 5/600; 5/611; 5/624; 5/634; 5/648; 5/651; 297/71

(58) Field of Search ..... 5/600, 602, 611, 5/621, 624, 634, 648, 649, 651; 128/845; 297/69, 70, 71, 75; 601/24; 378/209

(56) References Cited

U.S. PATENT DOCUMENTS

| | | | | | |
|---|---|---|---|---|---|
| 3,318,596 | A | | 5/1967 | Herzog | |
| 3,745,996 | A | | 7/1973 | Rush, Sr. | |
| 4,479,498 | A | * | 10/1984 | Toftness | 600/407 |
| 4,940,218 | A | | 7/1990 | Akcelrod | |
| 4,984,568 | A | * | 1/1991 | Persaud | 601/122 |
| 4,989,848 | A | | 2/1991 | Monroe | |
| 5,131,106 | A | | 7/1992 | Jackson | |
| 5,470,302 | A | * | 11/1995 | Krauss et al. | 601/2 |
| 5,658,315 | A | | 8/1997 | Lamb et al. | |
| 6,202,230 | B1 | * | 3/2001 | Borders | 5/624 |
| 6,286,164 | B1 | * | 9/2001 | Lamb et al. | 5/600 |
| 6,295,671 | B1 | * | 10/2001 | Reesby et al. | 5/600 |

* cited by examiner

*Primary Examiner*—David Bochna
*Assistant Examiner*—James M. Hewitt
(74) *Attorney, Agent, or Firm*—Stallman & Pollock LLP

(57) ABSTRACT

A medical table having a head end column and a pair of foot end columns, all of which are automatically and simultaneously extendable and retractable between upper and lower positions. A patient support system, which may include a body support and separate leg supports, is supported by the head and foot end columns.

14 Claims, 6 Drawing Sheets

MEDICAL TABLE HAVING CONTROLLED MOVEMENT AND METHOD OF USE

RELATED APPLICATIONS

This application is a divisional of application Ser. No. 09/044,363, filed Mar. 19, 1998, now U.S. Pat. No. 6,286,164.

FIELD OF THE INVENTION

The present invention relates generally to the field of tables for medical procedures and specifically to apparatuses and methods for raising and lowering medical tables.

BACKGROUND OF THE INVENTION

Many surgical and non-surgical medical procedures require positioning of the patient on a medical procedure table.

During orthopedic procedures, a medical procedure table (or "orthopedic table") functions to stabilize the patient and to deliver traction to one or both of the lower limbs of the patient by putting the legs in tension. In many orthopedic procedures it is necessary to abduct or adduct one or both of the legs (i.e. pivot it around its corresponding hip), while the patient is in a supine or lateral position, without relieving the traction force on the leg. Such procedures include hip pinning, casting of femoral and tibial fractures, and hip spica casting. In other procedures, such as femur nailing, it is necessary to position the patient on one side and to pivot the legs around the hips in the forward or reverse direction.

Common to many orthopedic tables is that the patient is positioned in a lateral or supine position on a table top, while his/her feet are connected to separate leg supports or traction units, each of which is attached to the distal end of an elongate spar member. Abduction and adduction of each leg is effected by pivoting the associated spar member around its proximal end.

During the course of an orthopedic or other medical procedure it may become necessary to elevate or lower the patient. Because the patient's back and legs are separately supported with tables such as those used for orthopedic tables, it is essential to coordinate the raising and lowering of the table top with that of the leg supports or traction units.

For example, one existing orthopedic table is comprised of a table top supported by a telescoping column near the head end of the table, and a pair of leg supports supported by a pair of telescoping columns near the foot end of the table. The lengths of the head and foot end columns are increased or decreased using telescoping action to raise or lower the patient. Typically, a table of this type is provided with a hydraulic pump which is activated to lengthen or shorten the head end column. The foot end columns are manually lengthened/shortened by releasing associated friction locks, adjusting the column length, and re-engaging the friction locks. Because each foot end column is bearing the load of one of the patient's legs, it typically requires at least one person to adjust a single foot end column. Activation of the hydraulic pump must be coordinated with movement of both foot end columns in order to prevent loss of traction in either or both legs. Simultaneous elevation of all three table columns thus typically requires simultaneous action on the part of at least three medical personnel.

It is thus desirable to provide a cost effective medical table for which different regions of the table may be simultaneously elevated. As will be fully appreciated from the following description, the medical table according to the present invention achieves this objective.

SUMMARY OF THE INVENTION

The present invention is a medical table having a head end column and a pair of foot end columns, all of which are automatically and simultaneously extendable and retractable between upper and lower positions. A patient support system, which may include a body support and separate leg supports, is supported by the head and foot end columns.

DETAILED DESCRIPTION

Structure

Throughout this description, the term "head end" of the table of the present invention 200 will be used to denote the regions 210 of the disclosed medical table which correspond to the positions of the head and torso of a patient positioned on the table. The term "foot end" will be used to denote the regions 220 of the table corresponding to the patient's leg and foot positions.

Figure 1:
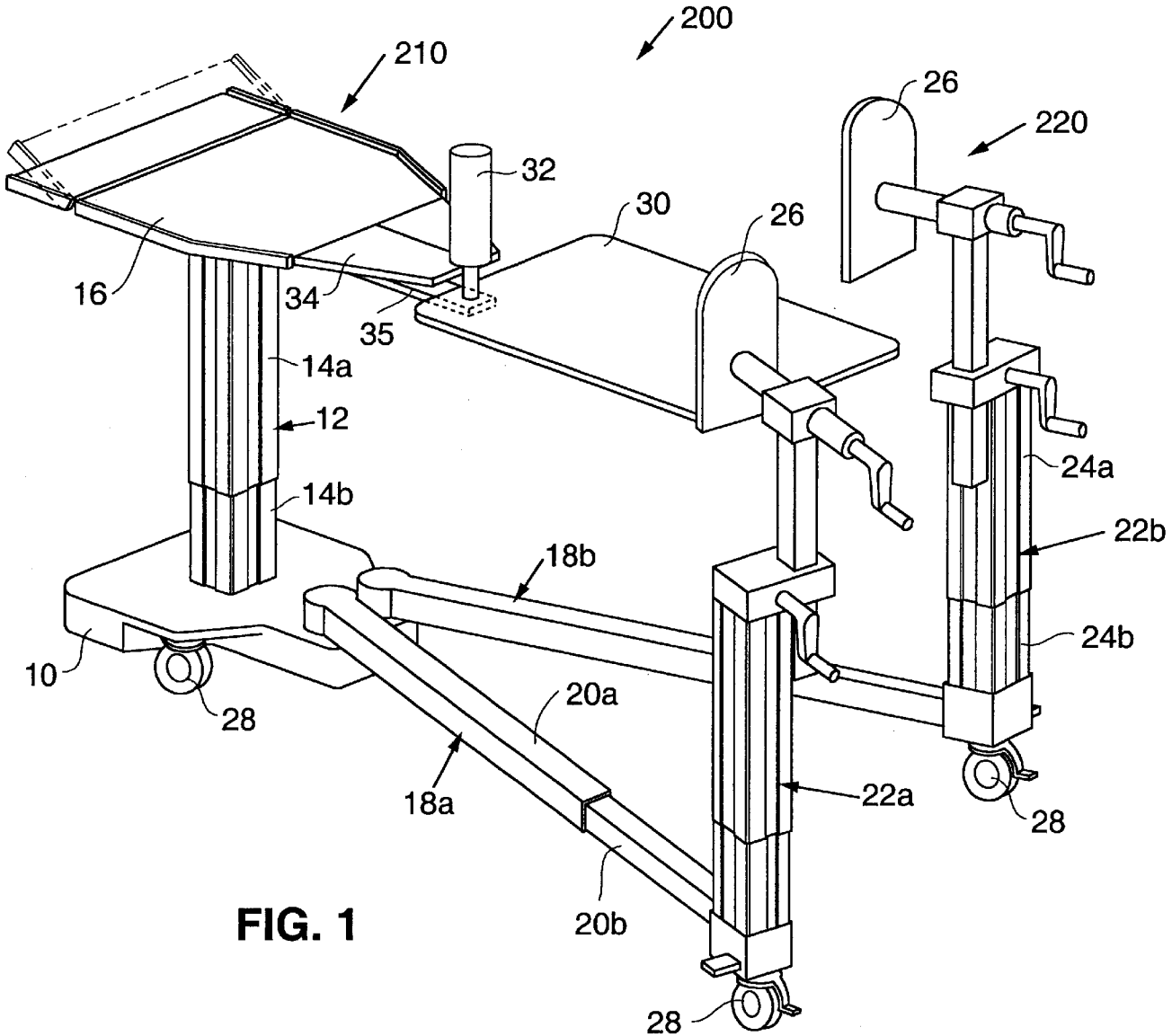
FIG. 1 is a perspective view of a medical table according to the present invention.

Referring to FIG. 1, located at the head end 210 are a base 10 and a vertically extending head end column 12. The head end column 12 includes upper and lower telescoping column members 14*a* and 14*b*. During use, the upper column member 14*a* is raised and lowered relative to the lower member 14*b* to increase or decrease the height of the table's head end. A body support such as table top 16 for supporting the patient's upper body is supported by the head end column 12.

Extending longitudinally from the base 10 towards the foot end 220 are a pair of spars 18*a*, 18*b*, each of which is pivotally attached to the base 10 to permit abduction and adduction of a patient's legs. Each spar 18*a*, 18*b* is preferably constructed of a pair of telescoping spar members 20*a*, 20*b* so that they may be lengthened or shorted as needed by sliding the distal most spar member 20*b* relative to the more proximal spar member 20*a*. Each spar 18*a*, 18*b* includes a locking mechanism, which may include an internally positioned rack member 21 and a releasable engaging member, to prevent inadvertent lengthening or shortening of the spars.

At the foot end of each spar 18*a*, 18*b* is a foot end column 22*a*, 22*b*. Like the head end column 12, the foot end columns 22*a*, 22*b* are formed of a pair of telescoping column members 24*a*, 24*b* which allow the columns 22*a*, 22*b* to be lengthened or shortened to raise or lower the foot end 220 of the table. Mounted on each foot end column 22*a*, 22*b* is a leg holder 26 which may be a conventional lithotomy leg holder or traction unit.

Wheels 28 support the base 10 and the foot end columns 22*a*, 22*b*. Each wheel is provided with a foot brake of a type conventionally used in order to prevent inadvertent movement of the table 200 and/or spars 18*a*, 18*b*.

The table may also be provided with a removable patient transfer board 30 (for temporarily supporting the patient's legs before they are moved into the leg supports), perineal post 32 (which provides counter-traction and maintains patient positioning), a detachable sacral rest 34, and a casting saddle 35 for hip spica casting, each of which may be of the type described and shown in U.S. Pat. No. 5,658,315 which is incorporated herein by reference.

Figure 2:
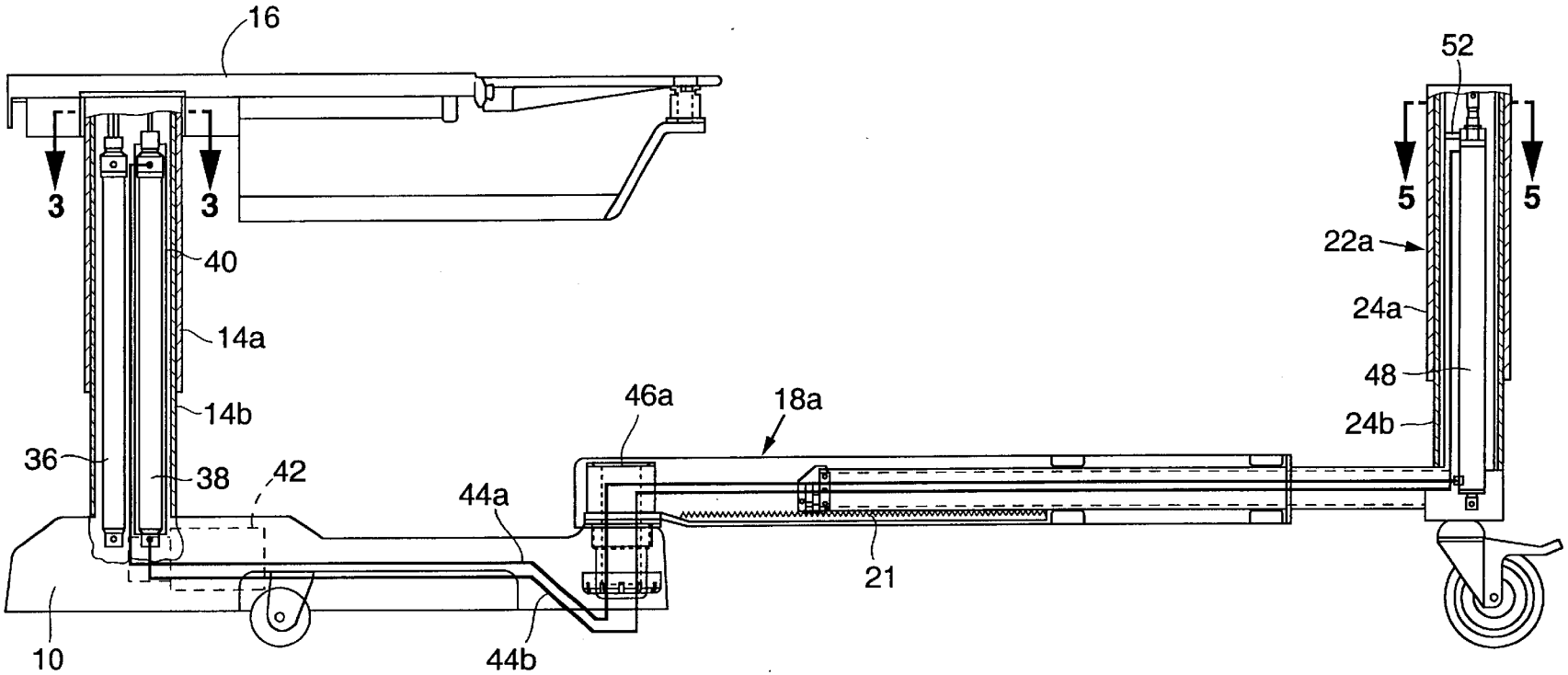
FIG. 2 is a side elevation view of the medical table of FIG. 1 which is partially cutaway to show the drive cylinders within the head and foot end columns.
Figure 3:
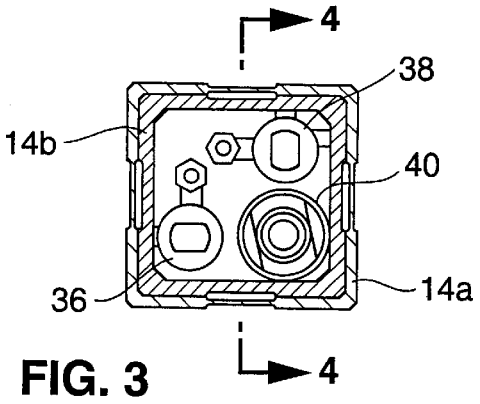
FIG. 3 is a cross-sectional top view of the head end column taken along the plane designated 3—3 in FIG. 2.
Figure 4:
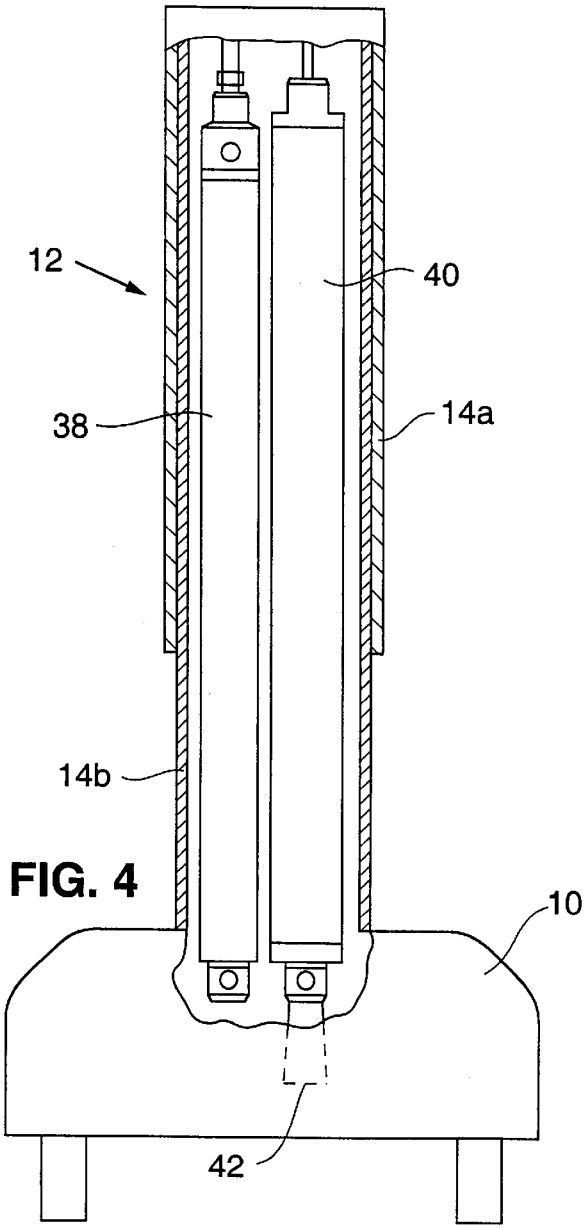
FIG. 4 is a partial cross-sectional end view of the head end column taken along the plane designated 4—4 in FIG. 3.

FIGS. 2 through 6 illustrate one configuration of a hydraulic system according to the present invention. Referring to FIGS. 2, 3 and 4, a pair of drive cylinders 36, 38 are disposed within the head end column 12. Each drive cylinder includes a piston (FIG. 7) extending from its upper end that is coupled to upper column member 14*a*. The lower end of each drive cylinder is coupled to lower column member 14*b*.

Also within the head end column 12 is a drive rod 40 having an upper end coupled to upper column member 14*a* and a lower end coupled to a drive actuator 42 which may be an electric motor.

As will be discussed in greater detail, the drive member 40 is moveable between upper and lower positions corresponding to high and low table top positions. Movement of the drive member 40 between upper and lower positions causes corresponding movement of the upper column member 14*a* between upper and lower positions. Moreover, because the drive cylinders 36, 38 are coupled to the upper column member 14*a*, upward movement of the drive member pulls the upper (piston) end of each drive cylinder in the upward direction. Conversely, when the drive member 40 causes downward movement of the upper column member, the drive cylinder piston ends are forced downwardly.

Referring to FIG. 2, each drive cylinder is fluidly coupled to a pair of fluid lines 44*a*, 44*b*. For simplicity, FIG. 2 schematically shows the fluid lines for only one of the drive cylinders 38 although it should be appreciated that similar fluid lines are coupled to the other drive cylinder 36. As shown, a first one of the fluid lines 44*a* is coupled to the upper section of the drive cylinder 38 and the second fluid line 44*b* is coupled to the lower section of the drive cylinder 38.

Fluid lines 44*a*, 44*b* extend through the base 10, through pivot connection 46*a* between the base and spar 18*a*, and through spar 18*a* to foot end column 22*a* as shown in FIG. 2. Similarly, the fluid lines (not shown) corresponding to drive cylinder 36 extend through pivot connection 46*b* and spar 18*b* and into foot end column 22*b*.

Figure 5:
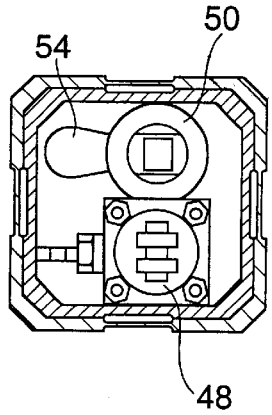
FIG. 5 is a cross-sectional top view of a foot end column of the medical table according the present invention, taken along the plane designated 5—5 in FIG. 2.
Figure 6:
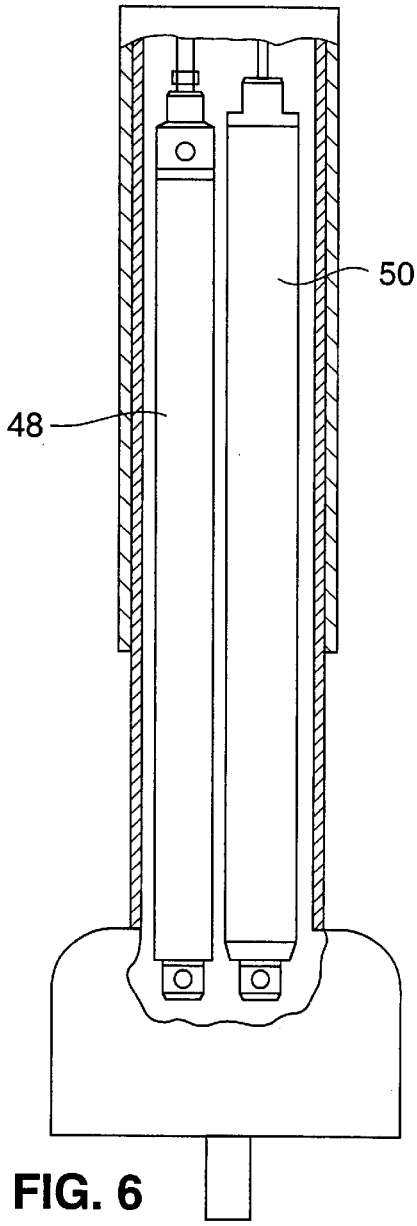
FIG. 6 is a cross-sectional end view of the foot end column of FIG. 5, taken along the plane designated 6—6 in FIG. 5.

Referring to FIGS. 2, 5 and 6, within each foot end column 22*a*, 22*b* is a pair of drive cylinders 48, 50. Drive cylinder 48 is fluidly coupled to fluid line 44*a* at its lower end and has an air port 52 at its upper end. Drive cylinder 50 has an air port 54 at its lower end and is fluidly coupled to fluid line 44*b* at its upper end. Although the figures show only the drive cylinder arrangement for foot end column 22*a*, a preferably identical arrangement is within foot end column 22*b*.

Figure 7:
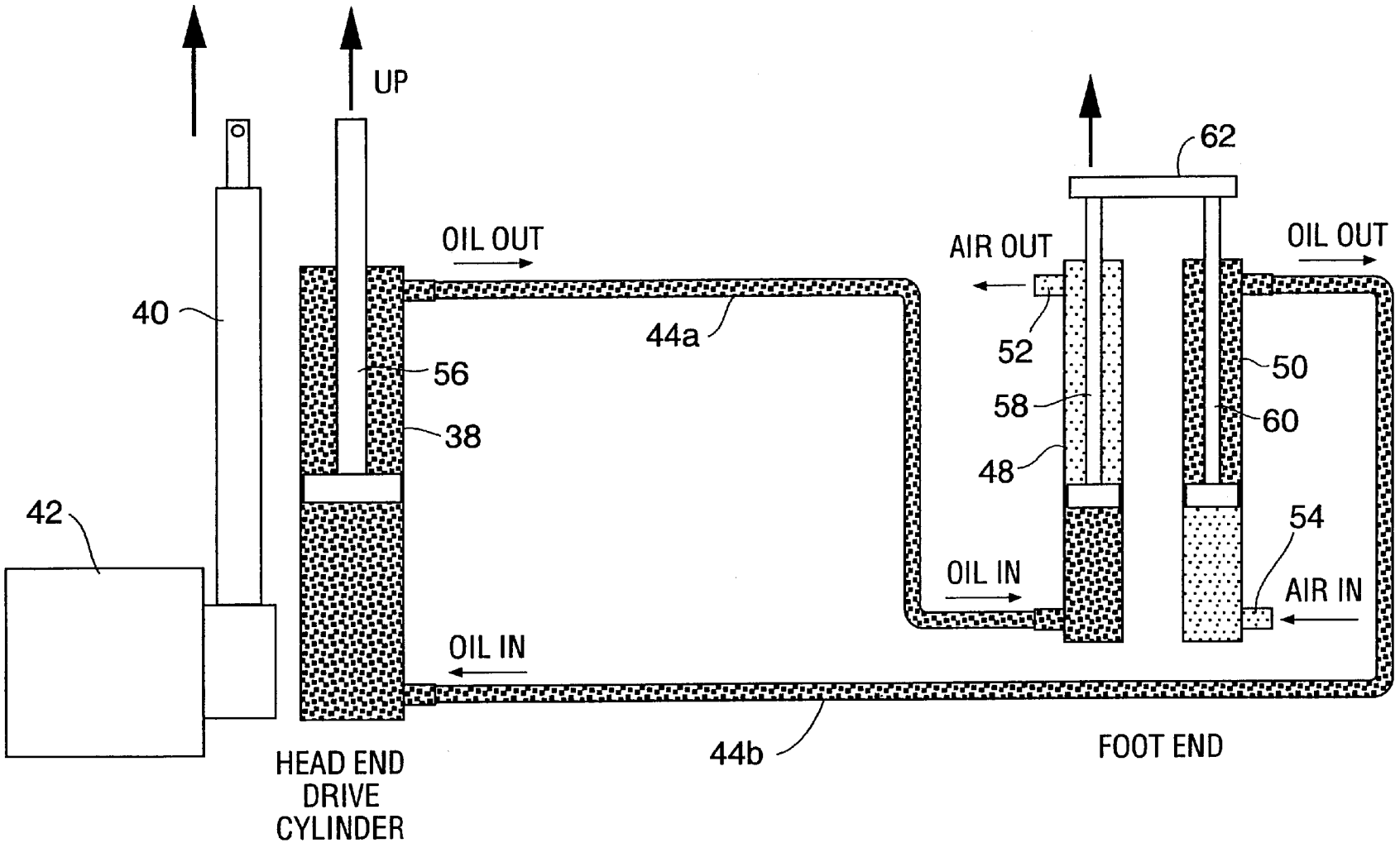
FIG. 7 is a schematic diagram illustrating operation of the hydraulic system associated with one of the foot end columns during elevation of the medical table of the present invention.

Each of the head end drive cylinders is fluidly coupled with the drive cylinders that are within one of the foot columns. In other words, head end drive cylinder 38 is fluidly coupled with the drive cylinders in foot end column 22*a*, while head end drive cylinder 36 is fluidly coupled with the drive cylinder in foot end column 22*b*. FIG. 7 schematically shows the hydraulic system corresponding to the head end drive cylinder 38 and the foot end column 22*a*. The system corresponding to drive cylinder 36 and foot end column 22*b* is preferably identical.

Drive cylinder 38 includes a piston 56 and is filled with oil both above and below the piston head.

Drive cylinders 48, 50 include pistons 58, 60 that are connected to one another by plate 62 so that they move up and down simultaneously. The plate 62 is connected to upper column member 22*a*. Drive cylinder 48 is filled with oil below the piston head and with air above the piston head. Drive cylinder 50 is filled with air below the piston head and with oil above the piston head.

As will be described in detail in the section entitled "Operation", upward or downward movement of the drive cylinders 48, 50 results when oil is caused to flow from a head end drive cylinder 38 into one of the foot end drive cylinders 48, 50. The oil flowing into the foot end drive cylinder pushes its corresponding piston upwardly or downwardly within the cylinder and induces like movement of the other of the drive cylinders because of the linking plate 62 between the pistons. As oil flows into a foot end drive cylinder and produces piston movement, oil flows out of the other of the drive cylinders to permit the piston within that drive cylinder to move freely as it is acted upon by the plate 62. For this reason, the volumes of the cylinders must be balanced so as to ensure that the movement of the pistons occurs in unison. Without a balancing of the drive cylinder volumes, the pistons will be unable to move in unison and the system will not operate fluidly.

Operation

Operation of the subject invention will next be described with continuing reference to FIGS. 7 and 8.

When it is desired to raise the medical procedure table, the user activates drive actuator 42 which discussed may be a manual foot pump or a motor. Drive actuator 42 causes upward movement of drive rod 40 which due to its connection with upper column member 14*a* causes elongation of the head end column 12. As the upper column member 14*a* is carried upwardly, it pulls the piston 56 of the head end drive cylinder 38 in an upward direction. Upward movement of the piston 56 pushes oil upwardly and out of the upper region of the drive cylinder 38 via fluid line 44*a*.

The oil flowing out of drive cylinder 38 flows from fluid line 44*a* into the lower portion of foot end drive cylinder 48 and pushes piston 58 upwardly. Because the pistons 58, 60 are linked to upper column member 24*a* (FIG. 1), the upward movement of the piston 58 pulls the upper column member 24*a* upwardly, thus elongating the foot end column 22*a* and raising the leg holder/traction unit 26 mounted to the column 22*a*. The upward movement of the piston 58 also causes air to be displaced from the drive cylinder and vented through port 52.

Because the foot end drive cylinder pistons 58, 60 are linked by plate 62, upward movement of piston 58 also pulls piston 60 upwardly. Oil in the upper portion of the drive cylinder 48 is forced out of the cylinder, into fluid line 44*b* and thus into the head end drive cylinder 38. As piston 60 moves upwardly within drive cylinder 50, air is drawn into its lower portion via port 54.

Figure 8:
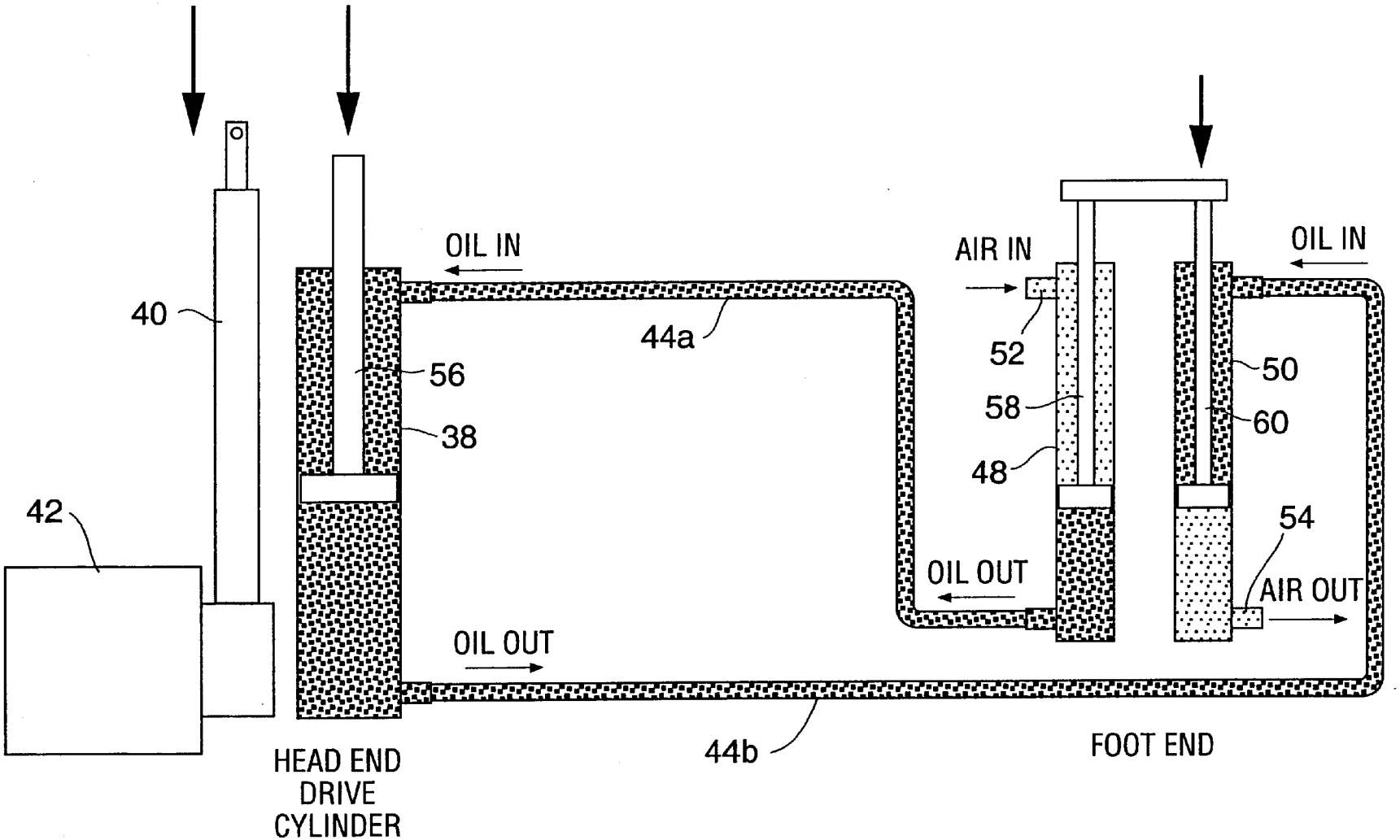
FIG. 8 is a schematic diagram illustrating operation of the hydraulic system associated with one of the foot end columns during lowering of the medical table of the present invention.

Referring to FIG. 8, when the table is to be lowered, the drive actuator 42 is activated to move the drive rod 40 downwardly and to thereby pull the piston 56 downwardly within head end drive cylinder 38. This movement pushes oil out of the drive cylinder via fluid line 44*b* and simultaneously allows flow of oil into the drive cylinder via fluid line 44*a*.

Oil displaced from drive cylinder 38 during downward movement of piston 56 flows into the upper portion of foot end drive cylinder 50, causing downward movement of piston 60 which in turn pulls upper column member 24*a*, drive plate 62, and piston 58 downwardly. The volume of oil displaced from drive cylinder 48 by the downward travel of piston 58 is carried into fluid line 44*a* and the upper portion of drive cylinder 38.

From the forgoing it can be appreciated that the table of the present invention allows the columns 12, 22*a*, 22*b* to be raised and lowered simultaneously simply by activating drive actuator 42. It should be further appreciated that while the table and system of the present invention has been described with respect to a single embodiment which is particularly suitable for orthopedic procedures (as evidenced by the Ovation (™) table available from Orthopedic Systems, Inc., Union City, Calif. which utilizes the hydraulic system described above and which is incorporated herein by reference), other embodiments may be conceived of without departing from the scope of the invention.

Figure 9:
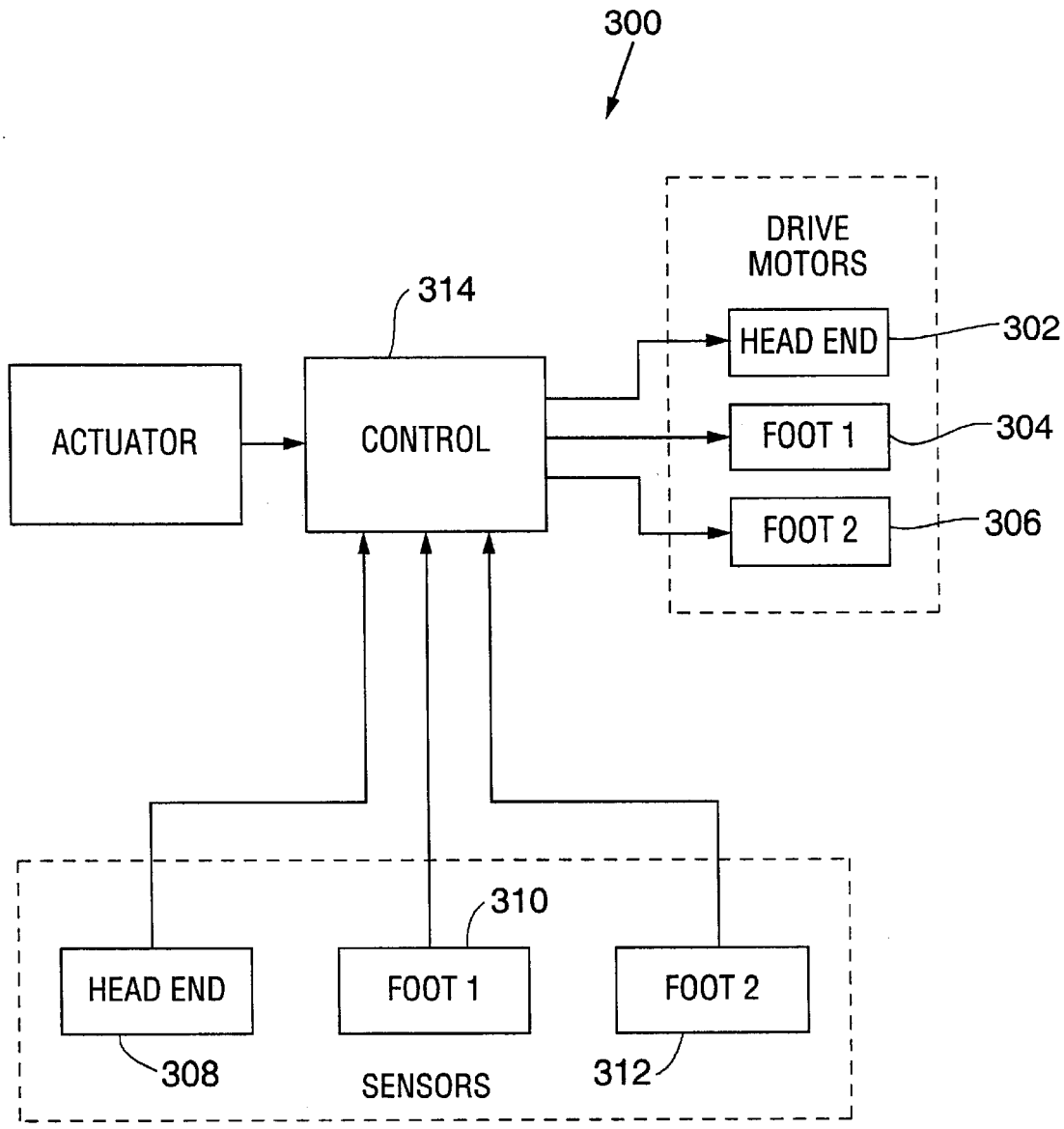
FIG. 9 is a schematic diagram of an alternative system for use in connection with the present invention for effecting simultaneous raising and lower of the head and foot ends of a medical table.

For example, while a hydraulic system has been described for simultaneously raising and lowering a patient's body and legs, other electrical and/or mechanical systems may be utilized without departing from the scope of the invention. For example, an alternative embodiment of a system 300 for effecting simultaneous extension and retraction of head and foot columns 12, 22*a*, 22*b* is schematically shown in FIG. 9. In the alternative system 300, separate electrical motors 302, 304, 306 may be installed in each of the columns (12, 22*a*, 22*b*) and linked with a feedback system. The feed back system includes sensors 308, 310, 312 and control circuitry 314. Because the columns are subjected to differing loads by the patients body and legs, the sensors 308–310 provide feedback to the control circuitry 314 which allows the drive motors 302, 304, 306 to be controlled in a manner which insures simultaneous elevation of the columns despite this unbalanced loading. The sensors may thus sense, for example, the elevational positions of the columns or the loads being placed on the columns.

As another example, a common drive cylinder may be utilized and linked with cables to actuate movement of all three posts. Thus, the scope of the present invention is not intended to be limited to the described embodiments, but is instead intended to be defined only in terms of the appended claims.

What is claimed is:

1. A medical table comprising:

a head end column and a pair of foot end columns, each of the head end column and the foot end columns including an upper portion and a lower portion, each upper portion extendable and retractable relative to the lower portion between upper and lower positions;

a patient support system supported by the head and foot end columns;

a first drive motor coupled to the head end column for movement of the head end column between upper and lower positions;

a second drive motor coupled to a foot end column for movement of said foot end column between upper and lower positions;

a third drive motor coupled to a foot end column for movement of said foot end column between upper and lower positions; and an actuator electronically coupled to each of the drive motors for affecting simultaneous movement of the head end column and foot end columns between the upper and lower positions;

control means electronically coupled to the actuator and to the drive motors, for controlling each of the drive motors; and sensor means associated with each of the head and foot end columns, for sensing relative positions of the head and foot end columns and for producing an output corresponding to said relative positions of the head and foot end columns, the control means being responsive to the output of the sensor means.

2. The medical table of claim 1, further comprising:

a pair of elongate spar members, each having a distal end connected to one or more of the foot end columns, the spar members longitudinally extendable and retractable to permit longitudinal positioning of the foot end columns.

3. The medical table of claim 2, wherein each spar member includes a proximal end and is pivotable about its proximal end for rotational positioning of the foot end columns.

4. The medical table of claim 1, further comprising:

a pair of elongate spar members, each having a proximal end and a distal end connected to one of the foot end columns, each spar member pivotable about its proximal end to permit rotational positioning of the foot end columns.

5. The medical table of claim 1, wherein the patient support system includes a pair of leg supports, each supported by one of the foot end columns, and a body support supported by the head end column.

6. A medical table comprising:

a head end column and a pair of foot end columns, each of the head end column and the foot end columns including an upper portion and a lower portion, each upper portion extendable and retractable relative to the lower portion between upper and lower positions;

a patient support system supported by the head and foot end columns;

a first drive motor coupled to the head end column for movement of the head end column between upper and lower positions;

a second drive motor coupled to a foot end column for movement of said foot end column between upper and lower positions;

a third drive motor coupled to a foot end column for movement of said foot end column between upper and lower positions; and an actuator electronically coupled to each of the drive motors for affecting simultaneous movement of the head end column and foot end columns between the upper and lower positions;

control means electronically coupled to the actuator and to the drive motors, for controlling each of the drive motors; and sensor means associated with each of the head and foot end columns, for sensing loads on the head and foot end columns and for producing an output corresponding to said loads, the control means being responsive to the output of the sensor means.

7. The medical table of claim 6, further comprising:

a pair of elongate spar members, each having a distal end connected to one or more of the foot end columns, the spar members longitudinally extendable and retractable to permit longitudinal positioning of the foot end columns.

8. The medical table of claim 7, wherein each spar member includes a proximal end and is pivotable about its proximal end for rotational positioning of the foot end columns.

9. The medical table of claim 6, further comprising:

a pair of elongate spar members, each having a proximal end and a distal end connected to one of the foot end columns, each spar member pivotable about its proximal end to permit rotational positioning of the foot end columns.

10. The medical table of claim 6, wherein the patient support system includes a pair of leg supports, each supported by one of the foot end columns, and a body support supported by the head end column.

11. A method for positioning a patient on a medical table, comprising the steps of:

(a) providing a medical table having a head end column and a pair of foot end columns, each of the head end column and the foot end columns including an upper portion and a lower portion, each upper portion extendable and retractable relative to the lower portion between upper and lower positions, the medical table further including a head end drive motor coupled to the head end column for moving the head end column between the upper and lower positions, and a pair of foot end motors each coupled to one of the foot end columns for moving the foot end column between the upper and lower positions, an actuator electronically coupled to each of the drive motors for affecting simultaneous movement of the head end column and foot end columns between the upper and lower positions, a controller electronically coupled to the actuator and to the drive motors, and a sensor associated with each of the head and foot end columns;

(b) positioning a patient on a patient support system coupled to the head and foot end columns; and (c) using the actuator to cause simultaneous movement of the head end and foot end columns between the lower and upper positions; and (d) sensing the relative positions of the head and foot end columns and producing an output corresponding to said relative positions using the sensor, and controlling operation of the drive motors in response to said output.

12. The method of claim 11, wherein the sensing step includes sensing respective loads placed on the head and foot end columns.

13. The method of claim 11, wherein step (a) further provides a pair of longitudinally extendable spar members, each having a distal end connected to one of the foot end columns; and the method further comprises the step of:

(d) selectively extending at least one of the spar members to reposition at least one of the leg supports.

14. The method of claim 13, wherein each spar member provided in step (a) includes a proximal end pivotally coupled to a support member; and the method further comprises the step of (e) pivoting at least one of the spar members about its proximal end.

* * * * *